US005516034A

United States Patent [19]

Jensen et al.

[11] Patent Number: 5,516,034

[45] Date of Patent: May 14, 1996

[54] PRODUCE TRAY

[75] Inventors: James R. Jensen, Fremont; Robert C. Olsen, Cupertino, both of Calif.

[73] Assignee: Jefferson Smurfit Corporation, Clayton, Mo.

[21] Appl. No.: 401,432

[22] Filed: Mar. 9, 1995

[51] Int. Cl.[6] ..... B65D 5/28

[52] U.S. Cl. ..... 229/120; 229/120.38; 229/916

[58] Field of Search ..... 229/120, 915, 229/916, 919, 191, 120.38

[56] References Cited

U.S. PATENT DOCUMENTS

| | | | |
|---|---|---|---|
| 2,163,117 | 6/1939 | Evans et al. | 229/916 X |
| 2,804,252 | 8/1957 | Nute | 229/916 X |
| 2,894,672 | 7/1959 | Bamburg | 229/916 X |
| 3,102,674 | 9/1963 | Hamilton | 229/120.38 X |
| 3,940,053 | 2/1976 | Putman et al. | 229/915 X |
| 4,266,714 | 5/1981 | Crane | 229/915 X |
| 5,203,494 | 4/1993 | Blomfield | 229/919 X |
| 5,433,373 | 7/1995 | Zoeller | 229/120.38 X |

*Primary Examiner*—Allan N. Shoap
*Assistant Examiner*—Christopher J. McDonald
*Attorney, Agent, or Firm*—Richard W. Carpenter

[57] ABSTRACT

A stackable, open top, paperboard, produce tray for holding and transporting articles that require considerable venting, The tray has side and end walls joined to and extending upwardly from side and end edges of a bottom wall, and the end wall are provided with aligned vent openings that accommodate the passage of air through the tray in a direction longitudinally of the tray to maximize the venting of articles in the tray. Also, the side walls of the tray are provide with internal cavities adapted to receive portions of star wire stacking wires.

6 Claims, 3 Drawing Sheets

T
40
59
46
5
30
25
20
57
8
SW
37a
3
DI
79
70
2
75
26
4
10
22
42
37
24

PRODUCE TRAY

BACKGROUND OF THE INVENTION

1. Field of the Invention

This invention relates to paperboard containers, and, more particularly, to a produce tray formed of foldable paperboard and having end walls provided with aligned vent openings in the upper and lower edges thereof to accommodate the passage of air through the tray in a direction longitudinally of the tray to maximize the venting of articles in the tray.

2. Description of the Background Art

A background art search directed to the subject matter of this invention conducted in the United States Patent and Trademark Office disclosed the following United States Letters Patent:

| | | | |
|---|---|---|---|
| 2,618,887 | 2,736,483 | 2,744,675 | 2,875,939 |
| 2,910,220 | 2,965,279 | 2,990,995 | 3,572,577 |
| 3,102,674 | 3,734,292 | 4,039,119 | 4,039,121 |
| 4,369,913 | 5,361,975 | RE 25,050 | |

None of the patents uncovered in the search discloses a produce tray formed of foldable paperboard that has three-ply end walls provided with aligned vent openings in the upper and lower edges thereof, to accommodate the passage of air through the tray in a direction longitudinally of the tray and thereby maximize the venting of articles in the tray, and that also has two-ply side walls with internal cavities, to accommodate the insertion of star wire stacking wires into the side walls when the tray is erected.

SUMMARY OF THE INVENTION

It is a primary object of the invention to provide a paperboard produce tray having a unique end wall construction that accommodates the passage of air through the tray.

Another object of the invention is the provision of a tray with two-ply side walls that is adapted to accept the manual insertion of star wire stacking wires into the side walls of the tray after the tray has been erected A more specific object of the invention is the provision of a produce tray of the type described with two-ply side walls and three-ply end walls that are provided with aligned vent openings in the upper and lower edges thereof to accommodate the passage of air through the tray in a direction longitudinally of the tray and thereby maximize the venting of articles in the tray.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figures 1, 2, 3, 4, 5, 6:
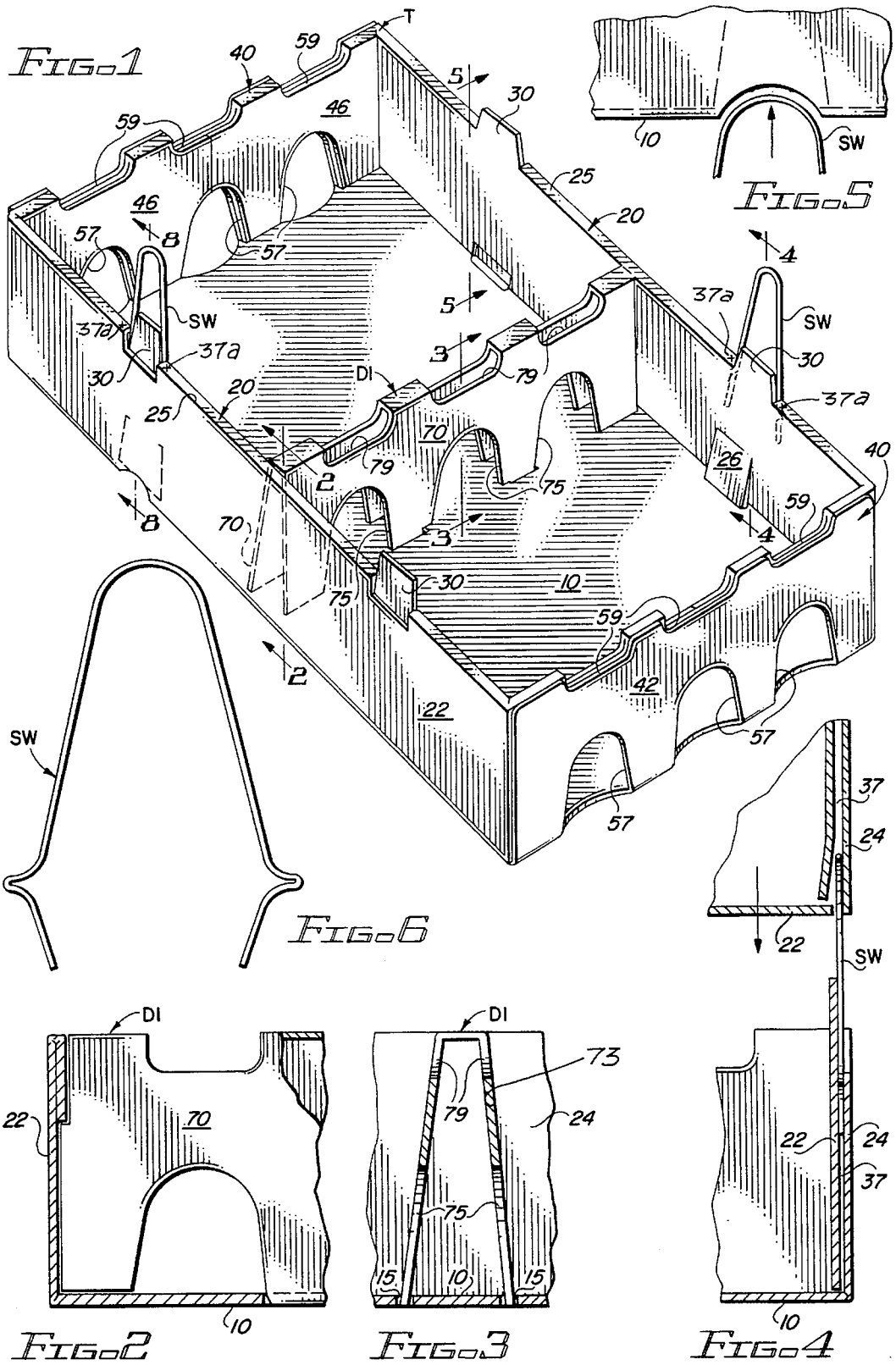
FIG. 1 is an isometric view of a produce tray embodying features of the present invention.
FIGS. 2, 3, and 4 are vertical sectional views taken on lines 2—2, 3—3, and 4—4, respectively, of FIG. 1.
FIG. 5 is a partial side elevational view of a portion of the structure illustrated in FIG. 1.
FIG. 6 is a side elevational view of a star wire stacking wire of the type shown in the other views.
Figure 10:
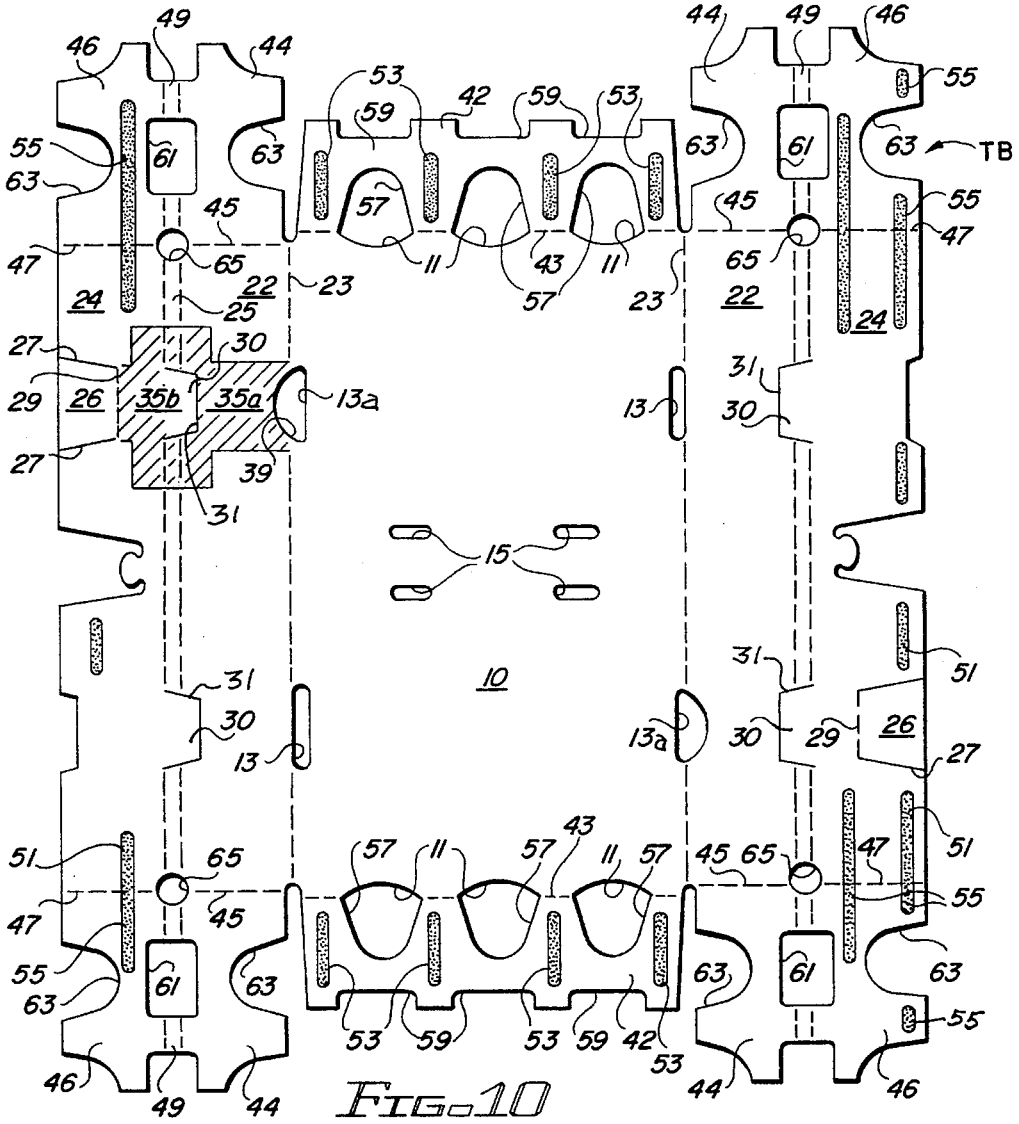
FIG. 10 is a plan view of the paperboard blank from which the tray illustrated in the other views is formed.

Referring now to the drawings for a better understanding of the invention, it will be seen that the invention relates to a container in the form of a produce tray, indicated generally at T in FIG. 1, which may be formed from a unitary blank TB of foldable sheet material, such as paperboard, illustrated in FIG. 10. Tray T is an open top container of the type used to hold articles A of produce, such as baskets of strawberries.

Venting of articles such as items of produce during transportation and storage is extremely important, but sometimes difficult, because of the way in which the produce trays are palletized.

In conventional produce trays of the type described, venting of the tray contents is accomplished by means of vent openings in the tray side walls, which allow the passage of air transversely through the trays; however it has been found to be far more desirable to vent the tray contents in such a way that the air can pass through the tray in a direction longitudinally of the trays.

This is because when trays are stacked on a standard 48" by 40" they are arranged in two rows of four each. Thus, when the trays are ventilated transversely, air must pass through four trays on each pallet; whereas, when the trays are ventilated lengthwise, as in the present invention, the air only has to pass through the contents of two trays, as illustrated best in FIG. 7.

Referring now to FIGS. 1 and 10 of the drawings, it will be seen that Tray T includes a generally rectangular bottom wall panel 10 having opposed pairs of side walls 20 and end walls 40 joined to and upstanding from opposed side and end edges thereof.

As best seen in FIG. 10, tray bottom wall panel has several openings extending therethrough. These include vent openings 11, located adjacent each end of the bottom wall panel; stacking tab receiving openings 13, located adjacent opposite side edges of the bottom wall panel; other openings 13*a*, also located adjacent opposite side edges of the bottom wall panel, and adapted to receive other lock tabs, upper portions of star wires, and finger tips; and center divider lock tab receiving openings 15, located in the central area of the bottom wall panel.

Side walls 20 each include an outer panel 22, foldably joined along a fold line 23 to a side edge of bottom wall panel; and an inner panel 24, foldably joined along a, preferably double scored, fold line 25 to an upper edge of outer panel 22.

Figure 9:
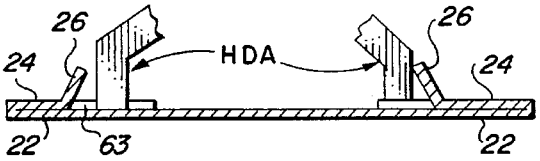
FIG. 9 is a partial sectional view illustrating the tray side wall gluing operation.

It should be noted that each side wall inner panel 22 is provided with a flap 26 that is defined by a cut line 27, fold line 29, and the lower edge of the panel. The purpose of the 26 is two-fold. First it accommodates entry of a finger tip which is required to push the tab aside to facilitate entry of an upper portion of a stacking wire; and second, it forms an opening or space, when lifted as illustrated in FIG. 9, to accommodate insertion of a hold down arm HDA to facilitate the formation of the side wall 20.

As best seen in FIGS. 1 and 10, each side wall inner panel 24 has projecting upwardly therefrom a pair of stacking tabs 30, each of which is defined by a cut line 31, that extends into the adjacent side wall outer panel. When the inner and outer panels are folded into face-to-face relation to erect the side walls, there is formed, adjacent each tab 30, an opening 37 adapted to receive a portion of a star wire type stacking wire SW, as shown in FIGS. 4 and 5.

Figure 12:
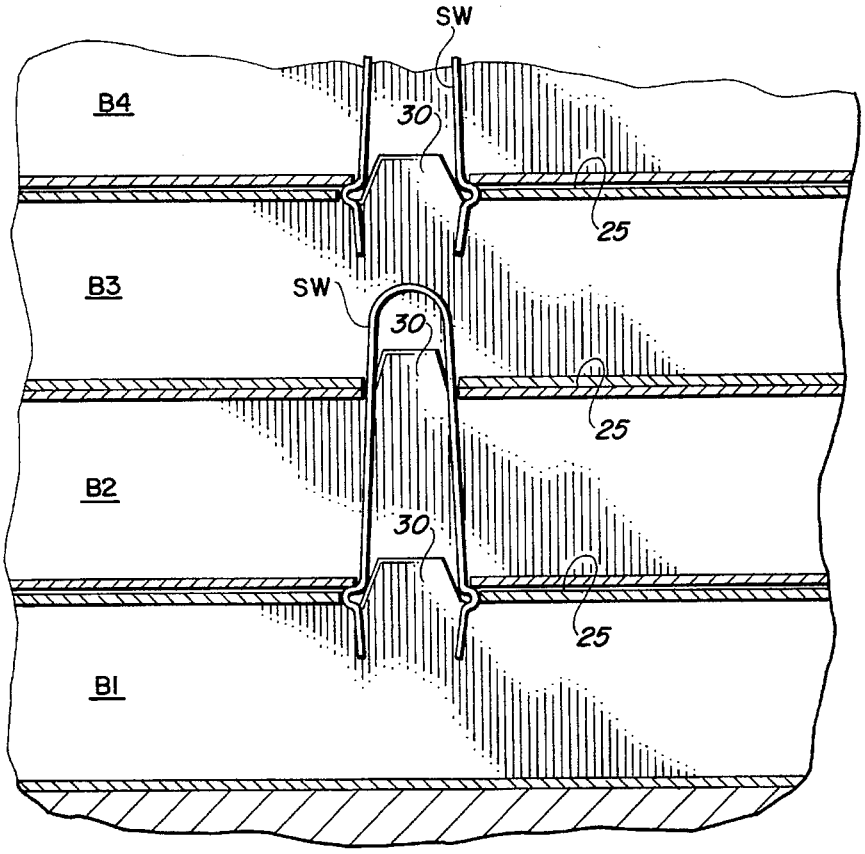
FIG. 12 is a partial, vertical, cross-sectional view of four trays stacked one atop the other to illustrate the relationship of the stacking wires to the respective trays.

As best seen in FIGS. 1 and 10, fold line 25, joining the side wall outer and inner panels 22 and 24, is a double score line providing a thin strip of material therebetween through which extends a pair of small X-shaped cuts 37*a*, located adjacent stacking tabs 30. The purpose of the cuts 37*a* is to provide openings for receiving lower portions of star wire stacking wires SW, as best seen in FIG. 12.

Referring again to FIG. 10, it will be seen that side wall outer and inner panels 22 and 24 have adjacent crushed areas 35*a* and 35*b*, respectively, which cooperate, when the panels are folded in face-to-face relation as the tray is erected, to form a hollow or cavity 37. The areas are, of course, crushed at the time the tray blanks B are formed in a press or die cutter.

The purpose of the cavity 37 is to receive portions of a stacking wire SW which, when trays are stacked one atop the other, extends upwardly from one tray B1, through bottom wall panel opening 13*a* of a second tray B2 and through the side wall of the second tray B2, and part way into a third tray B3, through its bottom wall opening 13*a*. Another stacking wire SW extends upwardly from the upper end of third tray B3 into an ajdacent fourth tray B4. This is best seen in FIG. 12.

Turning now to FIGS. 1 and 10, it will be seen that the end walls 40 are each triple-ply and include an outer panel 42, that are joined along fold line 43 to an end edge of bottom wall panel 10, and pairs of intermediate and inner panel sections 44 and 46.

End wall intermediate panel sections 44 are foldably joined, along fold lines 45, to end edges of related side wall outer panels 22, and end wall inner panel sections 46 are foldably joined, along fold lines 47, to end edges of related side wall inner panels 24. Each pair of end wall intermediate and inner panels have upper edges foldably joined to each other, along preferably double scored fold lines 49, which are aligned with related fold lines 25.

In erecting tray T from blank TB, adhesive is applied to the side wall inner panels 24, the end wall outer panels 42, and the end wall inner panel sections 46 as indicated at 51, 53, and 55, respectively, in FIG. 10.

The side wall inner panels 24 and the end wall inner panel sections 46 are then folded over and secured to the adjacent related side wall outer panels 22 and end wall intermediate panel sections 44. respectively. Then each related pair or set of end wall panel sections are folded inwardly and secured to the related end wall outer panels 42, which are folded upwardly into engagement with the end wall panel sections.

As previously mentioned, an essential feature of the invention is the design and construction of the end walls and the location of the vent openings therein which facilitate the passage of air in a direction lengthwise of the tray.

Figure 7:
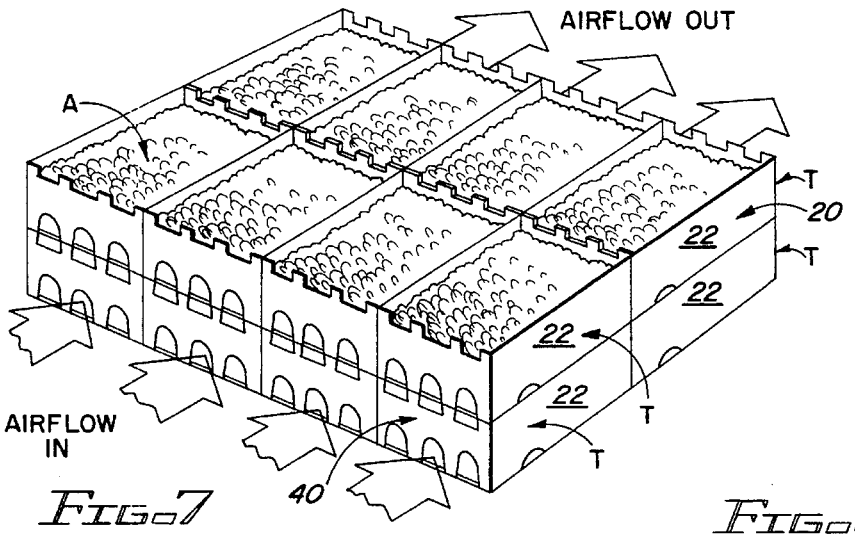
FIG. 7 is an isometric view of a plurality of produce trays, of the type illustrated in FIG. 1, shown stacked on a conventional pallet to insure maximum ventilation.
Figure 8:
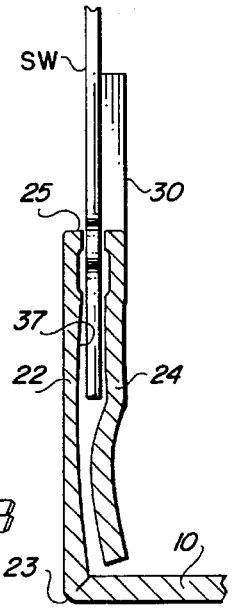
FIG. 8 is a vertical sectional view taken on line 8—8 of FIG. 1.

This is accomplished by the cooperating lower and upper vent openings 57 and 59 in the tray end wall outer panels, and the lower and upper openings 63 and 61 in the end wall intermediate and inner panel sections. This is best illustrated in FIGS. 1 and 7.

In order to facilitate the folding of the side and end wall panels, which are joined by aligned double score lines 25 and 49, respectively, blank TB may be provided with round holes 65 located in the areas where the double scored fold lines intersect.

Figure 11:
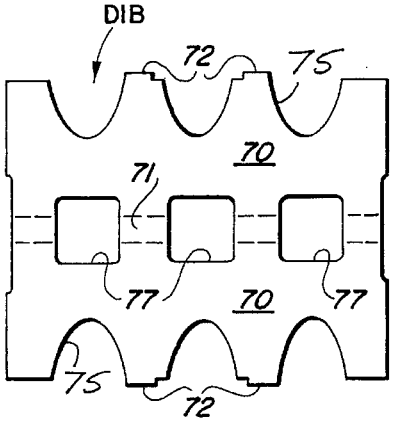
FIG. 11 is a plan view of the paperboard blank from which the divider insert illustrated in the other views is formed.

If desired, to add strength and rigidity to the tray T, it may be provided with a separate divider insert, indicated at DI. Divider Insert DI, illustrated best in FIG. 1, may be formed from the unitary blank DIB illustrated in FIG. 11.

Divider insert DI includes a pair of similar panels 70 which have upper edges foldably joined to each other along a preferably double scored fold line 71. When the divider insert is positioned within the tray T, the panels 70 are folded to form an inverted V-shape, with the end of the panels received within complementary openings 73 in the side wall inner panels 22.

Projecting from the lower edges of panels 70 are lock tabs 72 adapted to be received with complementary openings 15 in bottom wall panel 10 to retain the divider insert in position in the tray.

To maintain the longitudinal venting feature of the tray, the divider insert panels 70 are provided, in their lower and upper edges, with lower and upper vent openings 75 and 77, respectively, which are similar in size and shape to, and aligned with, the lower and upper vent openings in the end walls of the tray.

What is claimed is:

1. A stackable, open top, produce tray for holding and transporting articles that require a considerable amount of venting, said tray being formed from a unitary blank of foldable sheet material, such as paperboard, and comprising:

(a) a generally rectangular bottom wall panel having pairs of opposed side and end walls extending upwardly from opposed side and end edges thereof;

(b) each of said side walls including:

(i) a side wall outer panel having a lower edge foldably joined to one of said bottom wall panel side edges and extending upwardly therefrom;

(ii) a side wall inner panel having an upper edge foldably joined to an upper edge of said side wall outer panel and extending downwardly therefrom toward said bottom wall panel, and being adhesively secured to an inner surface of said side wall outer panel;

(iii) said side wall inner and outer panels having depressed areas in adjacent faces thereof that cooperate to form common openings in said side walls for receiving portions of stacking wires;

(c) each of said end walls including:

(i) an end wall outer panel having a lower edge foldably joined to one of said bottom wall panel end edges and extending upwardly therefrom;

(ii) a pair of co-planer end wall intermediate panel sections each having an end edge foldably joined to a related end edge of an adjacent one of said side wall outer panels and extending inwardly therefrom, and being adhesively secured to an inner surface of said end wall outer panel;

(iii) a pair of co-planer end wall inner panel sections each having an end edge foldably joined to a related end edge of an adjacent one of said side wall inner panels and extending inwardly therefrom, having an upper edge foldably joined to an upper edge of said adjacent one of said side wall inner panels and extending downwardly therefrom, and being adhesively secured to an inner surface of said adjacent one of said end wall intermediate panel sections;

(iv) said end wall outer panel and said end wall intermediate and inner panel sections having vent openings aligned with each other to accommodate the passage of air through said tray in a direction longitudinally of the tray to maximize the venting of articles in the tray.

2. A stackable, open top, produce tray for holding and transporting articles that require a considerable amount of venting, said tray being formed from a unitary blank of foldable sheet material, such as paperboard, and comprising:

(a) a generally rectangular bottom wall panel having pairs of opposed side and end walls extending upwardly from opposed side and end edges thereof;

(b) each of said side walls including:

(i) a side wall outer panel having a lower edge foldably joined to one of said bottom wall panel side edges and extending upwardly therefrom;

(ii) a side wall inner panel having an upper edge foldably joined to an upper edge of said side wall outer panel and extending downwardly therefrom toward said bottom wall panel;

(iii) said side wall inner and outer panels having depressed areas in adjacent faces thereof that cooperate to form common openings in said side walls for receiving portions of stacking wires;

(c) each of said end walls including:

(i) an end wall outer panel having a lower edge foldably joined to one of said bottom wall panel end edges and extending upwardly therefrom;

(ii) a pair of co-planer end wall intermediate panel sections each having an end edge foldably joined to a related end edge of an adjacent one of said side wall outer panels and extending inwardly therefrom, and being secured to said end wall outer panel;

(iii) a pair of co-planer end wall inner panel sections each having an end edge foldably joined to a related end edge of an adjacent one of said side wall inner panels and extending inwardly therefrom, having an upper edge foldably joined to an upper edge of said adjacent one of said side wall inner panels and extending downwardly therefrom, and being secured to said adjacent one of said end wall intermediate panel sections;

(iv) said end wall outer panel and said end wall intermediate and inner panel sections having vent openings aligned with each other to accommodate the passage of air through said tray in a direction longitudinally of the tray to maximize the venting of articles in the tray.

3. A unitary blank of foldable sheet material, such as paperboard, which is cut and scored to form a stackable, open top, produce tray for holding and transporting articles that require considerable venting, said blank comprising:

(a) a generally rectangular bottom wall panel having side and end edges;

(b) side wall outer panels having side edges foldably joined to said bottom wall panel side edges;

(c) side wall inner panels having side edges foldably joined to other side edges of said side wall outer panel;

(d) said side wall inner and outer panels having depressed areas therein that are arranged and disposed to cooperate with each other, when said tray is erected from said blank, to form common openings in said side walls for receiving portions of stacking wires;

(e) end wall outer panels having corresponding edges foldably joined said bottom wall panel end edges;

(f) pairs of co-planer end wall intermediate panel sections each having end edges foldably joined to related end edges of adjacent ones of said side wall outer panels:

(g) pairs of co-planer end wall inner panel sections each having end edges foldably joined to end edges of adjacent ones of said side wall inner panels, and each having side edges foldably joined to related side edges of related ones of said end wall intermediate panel sections;

(h) said end wall outer panel and said end wall intermediate and inner panel sections having vent openings extending therethrough that are arranged and disposed to be aligned with each other, when a tray is erected from said blank, to accommodate the passage of air through said tray in a direction longitudinally of the tray to maximize the venting of articles in the tray.

4. A stackable, open top, produce tray for holding and transporting articles that require a considerable amount of venting, said tray being formed from a unitary blank of foldable sheet material, such as paperboard, and comprising:

(a) a generally rectangular bottom wall panel having pairs of opposed side and end walls extending upwardly from opposed side and end edges thereof;

(b) each of said side walls including:

(i) a side wall outer panel having a lower edge foldably joined to one of said bottom wall panel side edges and extending upwardly therefrom;

(ii) a side wall inner panel having an upper edge foldably joined to an upper edge of said side wall outer panel and extending downwardly therefrom toward said bottom wall panel, and being adhesively secured to an inner surface of said side wall outer panel;

(c) each of said side wall inner panels having cut therein, adjacent a free edge thereof, a hinged flap arranged and disposed to be pushed aside to accommodate entry of an upper portion of a stacking wire into a space between said tray side wall panels, and also, when said tray is being formed, to provide an opening in said side wall inner panel receiving a tool used in the formation of said tray;

(d) each of said end walls including:

(i) an end wall outer panel having a lower edge foldably joined to one of said bottom wall panel end edges and extending upwardly therefrom;

(ii) a pair of co-planer end wall intermediate panel sections each having an end edge foldably joined to a related end edge of an adjacent one of said side wall outer panels and extending inwardly therefrom, and being adhesively secured to an inner surface of said end wall outer panel;

(iii) a pair of co-planer end wall inner panel sections each having an end edge foldably joined to a related end edge of an adjacent one of said side wall inner panels and extending inwardly therefrom, having an upper edge foldably joined to an upper edge of said adjacent one of said side wall inner panels and extending downwardly therefrom, and being adhesively secured to an inner surface of said adjacent one of said end wall intermediate panel sections;

(iv) said end wall outer panel and said end wall intermediate and inner panel sections having vent openings aligned with each other to accommodate the passage of air through said tray in a direction longitudinally of the tray to maximize the venting of articles in the tray.

5. A stackable, open top, produce tray for holding and transporting articles that require a considerable amount of venting, said tray being formed from a unitary blank of foldable sheet material, such as paperboard, and comprising:

(a) a generally rectangular bottom wall panel having pairs of opposed side and end walls extending upwardly from opposed side and end edges thereof;

(b) each of said side walls including:

(i) a side wall outer panel having a lower edge foldably joined to one of said bottom wall panel side edges and extending upwardly therefrom;

(ii) a side wall inner panel having an upper edge foldably joined to an upper edge of said side wall outer panel and extending downwardly therefrom toward said bottom wall panel;

(c) each of said side wall inner panels having cut therein, adjacent a free edge thereof, a hinged flap arranged and disposed to be pushed aside to accommodate entry of an upper portion of a stacking wire into a space between said tray side wall panels, and also, when said tray is being formed, to provide an opening in said side wall inner panel receiving a tool used in the formation of said tray;

(d) each of said end walls including:

(i) an end wall outer panel having a lower edge foldably joined to one of said bottom wall panel end edges and extending upwardly therefrom;

(ii) a pair of co-planer end wall intermediate panel sections each having an end edge foldably joined to a related end edge of an adjacent one of said side wall outer panels and extending inwardly therefrom, and being secured to said end wall outer panel;

(iii) a pair of co-planer end wall inner panel sections each having an end edge foldably joined to a related end edge of an adjacent one of said side wall inner panels and extending inwardly therefrom, having an upper edge foldably joined to an upper edge of said adjacent one of said side wall inner panels and extending downwardly therefrom, and being secured to said adjacent one of said end wall intermediate panel sections;

(iv) said end wall outer panel and said end wall intermediate and inner panel sections having vent openings aligned with each other to accommodate the passage of air through said tray in a direction longitudinally of the tray to maximize the venting of articles in the tray.

6. A unitary blank of foldable sheet material, such as paperboard, which is cut and scored to form a stackable, open top, produce tray for holding and transporting articles that require considerable venting, said blank comprising:

(a) a generally rectangular bottom wall panel having side and end edges;

(b) side wall outer panels having side edges foldably joined to said bottom wall panel side edges;

(c) side wall inner panels having side edges foldably joined to other side edges of said side wall outer panel;

(d) each of said side wall inner panels having cut therein, adjacent a free edge thereof, a hinged flap arranged and disposed to be pushed aside to accommodate entry of an upper portion of a stacking wire into a space between said tray side wall panels, and also, when said tray is being formed, to provide an opening in said side wall inner panel receiving a tool used in the formation of said tray;

(e) end wall outer panels having corresponding edges foldably joined said bottom wall panel end edges;

(f) pairs of co-planer end wall intermediate panel sections each having end edges foldably joined to related end edges of adjacent ones of said side wall outer panels:

(g) pairs of co-planer end wall inner panel sections each having end edges foldably joined to end edges of adjacent ones of said side wall inner panels, and each having side edges foldably joined to related side edges of related ones of said end wall intermediate panel sections;

(h) said end wall outer panel and said end wall intermediate and inner panel sections having vent openings extending therethrough that are arranged and disposed to be aligned with each other, when a tray is erected from said blank, to accommodate the passage of air through said tray in a direction longitudinally of the tray to maximize the venting of articles in the tray.

* * * * *